United States Patent [19]

Panzeri

[11] 3,964,136

[45] June 22, 1976

[54] SLIDING CLASP FASTENERS

[76] Inventor: Maria Luisa Panzeri, Via Vanvitelli 41, 20100 Milan, Italy

[22] Filed: Mar. 5, 1975

[21] Appl. No.: 555,635

[30] Foreign Application Priority Data

Mar. 8, 1974 Switzerland ..... 3335/74
May 13, 1974 Italy ..... 22630/74

[52] U.S. Cl. ..... 24/205.14 R
[51] Int. Cl.[2] ..... A44B 19/00
[58] Field of Search ..... 24/205.11 R, 205.14 R

[56] References Cited

UNITED STATES PATENTS 2,093,973 9/1937 Clark ..... 24/205.11 R

*Primary Examiner*—James C. Mitchell

[57] ABSTRACT

A sliding clasp fastener or zipper has an automatic bottom stop consisting of three parts: a male member and a female member which are secured to the opposite halves of the zipper after their last teeth and which are shaped for coupling engagement by rotating one towards the other, and a stopper element of parallelipipedic shape secured to either zipper half beneath the corresponding one of said members in such manner that its oblique sides lie substantially at right angles to the general plane of the zipper. One of the lower transverse edges of the stopper element is bevelled.

3 Claims, 8 Drawing Figures

SLIDING CLASP FASTENERS

This invention relates to a sliding clasp fastener or zipper having an automatic bottom stop.

By bottom automatic stop is meant a stop consisting of a male member and of a female member which are respectively secured to one edge of two tapes, each forming one half of the zipper, at the same time as the hooks or teeth, and whose assembly, by interlocking engagement is achieved by means of the sliding clasp when the latter is being fitted at the lower end of the two zipper halves. The male and female members are so shaped that once inserted into the sliding clasp, they are made to rotate one towards the other when the sliding clasp is moved upwards, with a projecting part provided on the male member being inserted into a recess provided in the female member. Further upward movement of the sliding clasp then causes the teeth to interlock thereby completing the interlocking engagement of the stop-constituting male and female members.

These two members, or one of them, then generally the female member, and the tooth adjacent the latter are provided with projecting parts and recesses that engage one another and which form an abutment for the bottom end of the sliding clasp when the latter is being moved towards the lower end of the fastener. The abutment thus prevents the sliding clasp from moving down into a position liable to cause separation of the male and female members that were automatically coupled together during positioning of the sliding clasp to form the bottom stop.

An automatic bottom stop thus has the advantage over a subsequently fitted stop, i.e. fitted after the sliding clasp has been put in place, that it enables the fastener components to be simultaneously injection moulded and that it enables the finishing operations (gauging, brushing, galvanizing, enamelling, etc.) to be carried out without being hindered by the presence of a sliding clasp.

However, known automatic bottom stops also suffer from certain drawbacks which adversely affect their use in sliding clasp fasteners. For instance, the automatic formation of these stops, by coupling together the male and female members, requires these members to be in correct facing relationship, i.e. in a relative position such that coupling may take place by rotating these members one towards the other under the action of the sliding clasp. Now, the presence of projecting parts on at least one of the members gives rise to friction between the sliding clasp and the projecting parts and hence a modification of the relative position of the two members to be coupled. Their coupling by means of automatic machines thus becomes highly uncertain so that the manufacture of continuous chains is virtually impossible.

Further, the finishing operations are liable to damage the projecting parts or even to cause them to disappear thus making it impossible to form an automatic stop since the sliding clasp cannot be stopped when moved downwards. Moreover, known automatic bottom stops can only be used with closed end zip fasteners, i.e. at the inseparable lower ends, because the male and female members previously coupled by the sliding clasp can no longer be separated as a result of the latter being blocked by the stop.

An object of the invention is to provide a sliding clasp fastener having an automatic bottom stop which does not suffer from the above mentioned drawbacks and which can be used both with open end zippers and with closed end zippers.

The sliding clasp fastener provided by the invention is characterized in that the stop comprises a male member and a female member which are respectively secured to the opposite halves of the fastener after their last teeth and which are shaped for coupling engagement by rotating one towards the other and comprises a stopper element of oblique parallelipipedic shape secured to one of the fastener halves beneath one of said members, so that its oblique sides lie substantially at right angles to the general plane of the fastener, one of the lower edges of the stopper element, that are parallel to the fastener plane, being bevelled.

Figure 1:
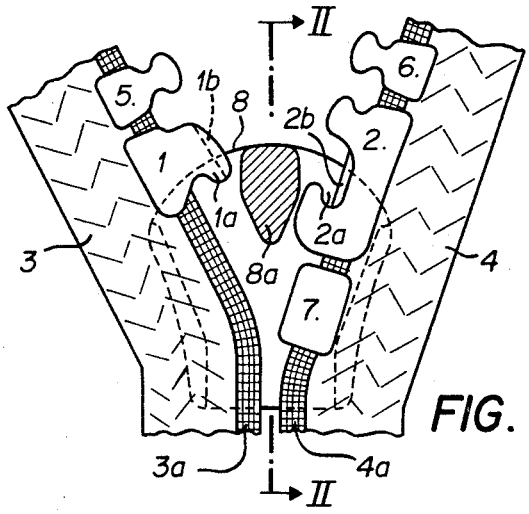
FIG. 1 is a plan view of the lower end portion of a first embodiment of the sliding clasp fastener according to the invention while being fitted with its sliding clasp shown in cross-section.

The zipper end portion shown in FIG. 1 is provided with a male member 1 and a female member 2 which are respectively secured to the edges 3*a* and 4*a* of tapes 3 and 4, after the last teeth 5 and 6 on the tapes. The tapes and their associated teeth each form one half of the zipper. The members 1 and 2 respectively comprise a projecting part 1*a* and a recess 2*a* which are of complementary shape to enable them to be coupled together when rotated one towards the other. Moreover, one of the two members 1 and 2 is provided with a groove and the other with a tongue adapted for engagement in the groove when the two parts are being coupled together so as to prevent relative displacement thereof at right angles to their planes and hence their coming apart. In the present instance, it is the male member 1 which has a groove 1*b* and the female member 2 which has a tongue 2*b*.

Beneath the female member 2 there is secured a stopper element 7 of oblique parallelipipedic shape having one of its bottom edges that are parallel to the plane of the fastener blunted so as to form a bevel 7*a*. The stopper element 7 is so secured to the edge of the tape that its oblique sides lie substantially at right angles to the plane of the tape and hence of the fastener.

In FIG. 1, the sliding clasp 8, illustrated in cross-section, is shown being put into place and in particular in a position in which its wedge 8*a* lies between the two members 1 and 2. The flexibility of the tape 4, on the edge of which is secured the stopper element 7, and the bevel 7*a* of the latter enable the stopper element to orient itself, in relation to the guiding channel of the clasp, in such a way as to enable the latter to be put into place and moved upwards and at the same time to subject the two tapes 3 and 4, and hence the members 1 and 2, to a rotational movement towards one another about the lower end portions of the tapes.

Figure 3:
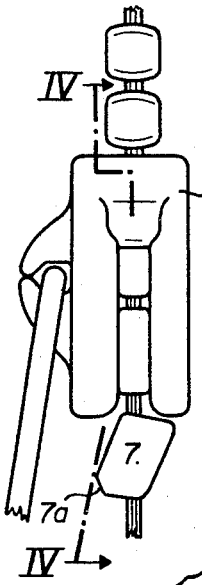
FIG. 3 is a side view of the lower end portion of a second embodiment of the sliding clasp fastener according to the invention, with the sliding clasp, shown in cross-section, in its lowermost operative position.
Figure 4:
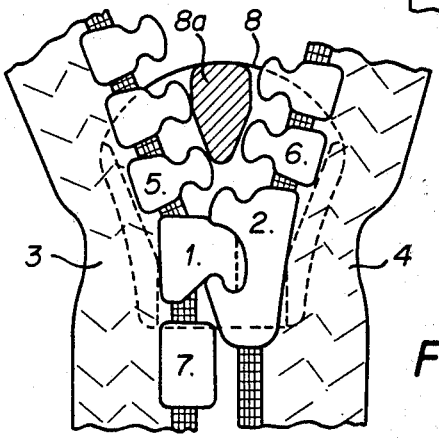
FIG. 4 is a section along line IV—IV of FIG. 3.

In FIG. 4 the clasp 8 is shown in a position where its bottom is located above the stopper element 7 which is here secured beneath the male member 1. The stopper element 7 being now released from the clasp 8, the tape 3 to which it is secured may straighten itself and move the stopper element 7 into the position shown in FIG. 3. It will be observed that the stopper element 7 in this position forms an abutment for the clasp 8, preventing the latter to move any lower.

Figure 5:
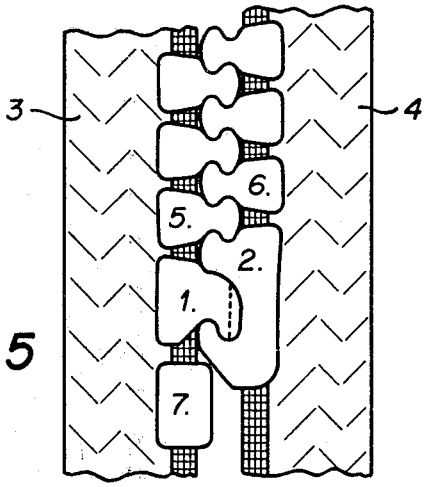
FIG. 5 shows the lower end portion of the fastener of FIGS. 3 and 4 when closed.

In this position of the clasp, the two members 1 and 2 are already interlocked and upward movement of the clasp will cause interlocking of the zipper teeth. FIG. 5 shows the lower portion of the closed zipper. When opening the zipper, by downward movement of the clasp, the bottom of the latter abuts against the stopper element (see FIG. 3) so that the end portions of the two zipper halves will remain assembled by virtue of the interlocked condition of the members 1 and 2 which, together with the stopper element, constitute the automatic bottom stop of the zipper.

As will be noted from FIG. 4, the stopper element 7 is secured beneath the male member 1 at a distance such that the clasp 8 abuts against the stopper element 7 before its wedge 8*a* reaches the members 1 and 2. It is therefore no longer possible to separate these two members and hence to separate the two halves of the zipper which is thus of the closed end kind.

In the case of an open end zipper it is necessary for the stopper element, which constitutes the third part of the automatic bottom stop, to be secured to the tape carrying the male member, beneath the latter and at a distance such therefrom that it will stop the clasp before it will, as it moves into its lowermost position, cause the male member 1 to rotate in a direction such as to cause it to disengage itself from the female member 2.

Figure 2:
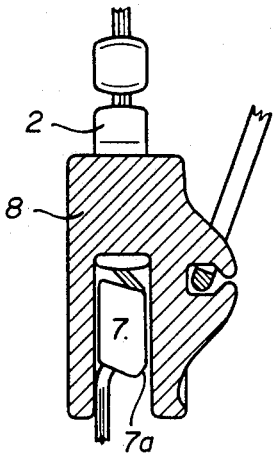
FIG. 2 is a section along line II—II of FIG. 1.
Figure 6:
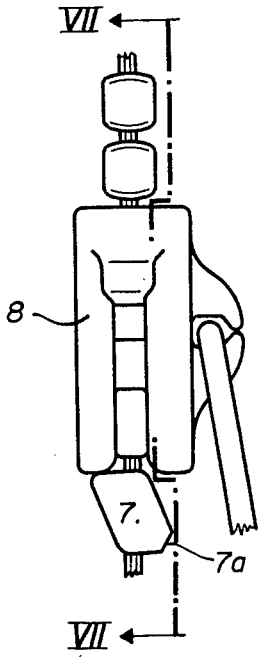
FIGS. 6 to 8, which correspond to FIGS. 3 to 5, further illustrate the embodiment of FIGS. 1 and 2.
Figure 7:
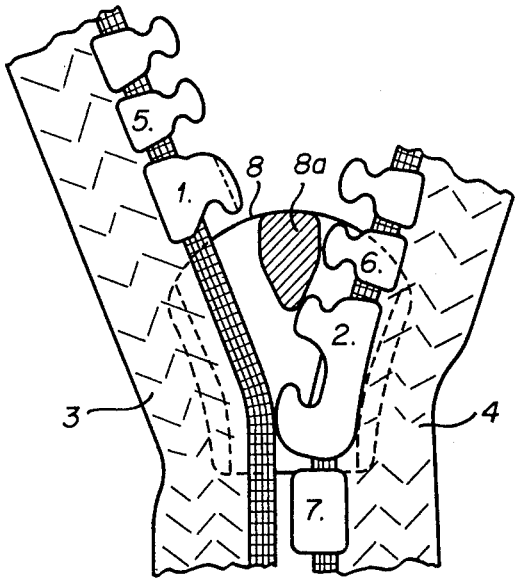
Figure 8:
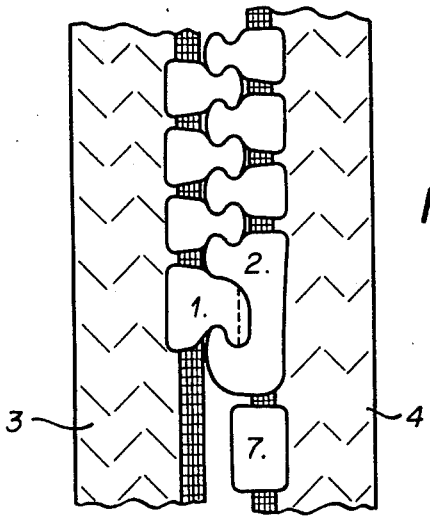

FIGS. 6 to 8, which correspond to FIGS. 3 to 5, illustrate a zipper in which the stopper element 7 is secured to the tape carrying the female member 2, as in FIGS. 1 and 2, at a distance therefrom such that the clasp cannot be stopped before reaching a position in which it will cause the male member 1 to swing out of the female member 2. FIG. 7 illustrates one such position of the clasp. It will be observed that it is then possible to extract the tape 3 from the clasp 8 by pulling it upwardly and hence to separate the two halves of the zipper which is thus of the open end kind.

The automatic bottom stop arrangements described above can therefore be used both on open end and closed end zippers. Their components do not have any projecting parts liable to hinder their assembly by automatic machines or any finishing operations on the zipper before such assembly.

I claim:

1. In a zipper including two opposing flexible tapes, each having a row of interlockable teeth, and a channeled sliding clasp having a handpull and an inner wedge and adapted to lock and release said teeth, the improvement comprising: a three-piece automatic bottom stop attached to said tapes at one end of the row of interlockable teeth, and comprising a first bottom stop piece having a first-tape engaging side and a male member side, said male member side extending downwardly between the opposing tapes and in the path of the sliding clasp, a second bottom stop piece having a second-tape engaging side and a female member side comprising a cavity extending downwardly and being adapted to receive the male member in a hook lock, the upper end of said female member having a tooth shaped portion allowing this member to act as a continum of the row of zipper teeth, and a third bottom stop piece oblique parallelepiped form defining a pair of opposite parallelogram faces and including a tape engaging groove extending in the entire length of one of said parallelogram faces substantially at right angles to the base of the parallelepipedic piece, said third bottom stop piece being positioned on one of said tapes by means of said groove at a distance from said first and second bottom stop pieces, the edge of said third bottom stop piece extending between the lower acute angles of said parallelogram faces being bevelled, said third bottom stop piece being sized so as to be capable of fully passing through the channel in said sliding clasp during initial installation of said sliding clasp on said zipper tapes.

2. The zipper according to claim 1 in which the third bottom stop piece is positioned on the same tape as the first bottom stop piece at a distance beneath the latter such the bottom end of said sliding clasp will abut against the top end of the third bottom stop piece before its inner wedge reaches said first and second bottom stop pieces.

3. The zipper according to claim 1 in which the third bottom stop piece is positioned on the same tape as the second bottom stop piece at a distance beneath the latter such that the inner wedge of said sliding clasp will insert itself between said male and female members before the bottom end of the sliding clasp abuts against the top end of the third bottom stop piece.

* * * * *